US008615930B2

(12) United States Patent
Ryberg et al.

(10) Patent No.: US 8,615,930 B2
(45) Date of Patent: Dec. 31, 2013

(54) LIFTING DEVICE ADAPTED TO BE MOUNTED IN AN OPENABLE STRUCTURE

(75) Inventors: Jesper Ryberg, Taastrup (DK); Klaus Kornerup, Birkerød (DK); Niels Henrik Toft-Jensen, Søborg (DK)

(73) Assignee: VKR Holding A/S, Hoersholm (DK)

( * ) Notice: Subject to any disclaimer, the term of this patent is extended or adjusted under 35 U.S.C. 154(b) by 0 days.

(21) Appl. No.: 13/138,620

(22) PCT Filed: Mar. 12, 2009

(86) PCT No.: PCT/DK2009/050053
§ 371 (c)(1),
(2), (4) Date: Oct. 28, 2011

(87) PCT Pub. No.: WO2010/102623
PCT Pub. Date: Sep. 16, 2010

(65) Prior Publication Data
US 2012/0036783 A1 Feb. 16, 2012

(51) Int. Cl.
*E05F 1/10* (2006.01)
*E05D 13/00* (2006.01)

(52) U.S. Cl.
USPC ..... 49/386; 16/197

(58) Field of Classification Search
USPC ..... 52/200; 49/387, 386, 138; 16/319, 16/337–342, 193, 197, 199, 200, 400, 401
See application file for complete search history.

(56) References Cited

U.S. PATENT DOCUMENTS

| | | | | |
|---|---|---|---|---|
| 3,187,374 | A * | 6/1965 | Lundell | 16/289 |
| 3,457,584 | A * | 7/1969 | Phelps | 16/290 |
| 3,714,680 | A * | 2/1973 | Little | 6/290 |
| 3,737,947 | A * | 6/1973 | Little | 16/290 |
| 3,902,220 | A * | 9/1975 | Little | 16/290 |

(Continued)

FOREIGN PATENT DOCUMENTS

| | | |
|---|---|---|
| DE | 2 337 459 | 7/1973 |
| DE | 20 2006 014988 | 12/2006 |

(Continued)

OTHER PUBLICATIONS

Machine Translation of EP1052342.*

*Primary Examiner* — Katherine Mitchell
*Assistant Examiner* — Scott Denion
(74) *Attorney, Agent, or Firm* — Merek, Blackmom & Voorhees, LLC

(57) ABSTRACT

The lifting device comprises abiased slide shoe adapted to be slidable with respect to a member of an openable structure, a lifting arm having two ends, one end adapted to be pivotally connected with a member of the structure and the other end associated with said slide shoe, and a braking device comprising at least one brake shoe slidable on a respective brake face of said lifting device, said braking device modulating the force resulting from the bias on said biased slide shoe. An adjusting device is adapted to adjust said progressive modulation of said force resulting from the bias on said biased slide shoe, and comprises a manipulation member, which when manipulated by a user activates said adjusting device to adjust a brake force of said brake shoe exerted on said brake face in a given position of said brake shoe.

31 Claims, 7 Drawing Sheets

(56) References Cited

U.S. PATENT DOCUMENTS

| | | | | | |
|---|---|---|---|---|---|
| 3,950,819 | A * | 4/1976 | Little | 16/290 |
| 4,015,309 | A * | 4/1977 | Gronbach | 16/290 |
| 4,217,732 | A * | 8/1980 | Reichstadt | 49/153 |
| 5,615,522 | A * | 4/1997 | Tomanek | 52/72 |
| 5,689,916 | A * | 11/1997 | Jensen et al. | 49/252 |
| 7,051,843 | B2 * | 5/2006 | Zimmer et al. | 188/67 |
| 7,568,260 | B2 * | 8/2009 | Wu | 16/197 |

FOREIGN PATENT DOCUMENTS

| | | |
|---|---|---|
| EP | 0 733 146 | 6/1997 |
| EP | 1 052 342 | 11/2000 |
| EP | 1 111 174 | 6/2001 |
| EP | 1 873 323 | 1/2008 |

* cited by examiner

LIFTING DEVICE ADAPTED TO BE MOUNTED IN AN OPENABLE STRUCTURE

BACKGROUND OF THE INVENTION

Openable structures of the mentioned kind are typically in the form of for example top-hung windows installed in inclined surfaces, e.g. a roof of a building, the first member being a side sash member, and the second member being a side frame member of said window, or vice versa. A respective lifting device with a spring-biased slide shoe connects a respective side frame member and a respective sash side member on each side of the window. It is an aim in such windows to ensure that the force needing to be exerted by a user on the window sash when opening or closing of the window does not vary too much during the travelled path of the window sash, no matter of the roof inclination of the roof in which the window is installed and no matter variance of the weight of the window sash. The window sash weight may vary due to for example installation of optional accessories such as miscellaneous screening devices, e.g. blackout curtains, some of which can be installed on mounted windows. In an attempt to alleviate this, applicant's EP 0 733 146 A suggests to provide an adjustable auxiliary spring in the lifting device to increase the spring bias within certain opening angles in windows mounted in roofs with certain roof inclinations.

The biased slide shoe of such lifting devices is mounted on and moves in parallel with or along either the side frame member or the side sash member. The slide shoe typically slides in a guidance mounted on the respective sash or frame member. The slide shoe is typically biased by means of a spring arrangement located in parallel with the respective sash or frame member, and pivotally connected to a lifting arm, the other end of which is pivotally connected with the other of the side sash member or side frame member. During opening and closing of the window the slide shoe slides in the guidance, providing a frictional braking force normal to a guidance bottom face, which in turn allows for the window to be placed in positions between fully opened and fully closed. When the window is opened, the lifting arm moves from a position near parallel with the frame or sash member on which the guidance is mounted to a position with an angle to both of these. In the angled position the frictional force exerted by the slide shoe on the guidance, and hence the braking effect, is inherently somewhat larger. Conversely, because the frictional force from the slide shoe normal to the guidance bottom face decreases during closing of the window, in a near-closed position of the window the braking effect is lower, making the window sensitive to influences such as wind forces in the near closed position. Thus, it is also an aim in such windows that with any roof inclination and weight of optional accessories mounted on the window sash the frictional or braking forces working during operation are such that the window can be firmly positioned in any opening degree, i.e. without the risk of sliding out of position because of for example gravitational or wind-induced forces exerted on the movable part of the window.

EP 1 052 342 B suggests as a solution to the latter problem a lifting device, in which a braking effect of a braking device is adjustable by means of a threaded bolt. The threaded bolt adjusts the force exerted by two lateral brake shoes on respective lateral brake faces of a guidance of the lifting device. This makes it possible to add a constant braking effect exerted in the entire path between fully opened and fully closed positions of the window, this added braking effect not being dependant on the bias on the slide shoe or the position of the window. If this braking device is adjusted to be able to hold the movable window part in a near-closed position, the accumulated braking effect is larger than desired in positions of larger opening angles, making it too hard for a user to bring the window from one position to another within these angles. Further, this braking device is subjected to wear and frequently needs to be replaced or readjusted.

A lifting device according to the introductory part of claim 1 and suggesting another solution to the problem of providing a suitable braking force in all positions of the window is known from applicant's EP 1 873 323 A. In this lifting device, the slide shoe comprises a braking device, which modulates a force resulting from the bias on the slide shoe in variation of a magnitude of said force, i.e. in variation of the path of the slide shoe. This provides for a path-dependent braking effect, which can be arranged to ensure that the braking effect is greater within the opening angles in which it is needed (i.e. near-closed window). The braking device comprises a linkage mechanism having two brake members connected with each other by a link extending at an angle with respect to a guidance portion forming at least one face in contact with a respective brake member. However, a window provided with this lifting device is only suitable with windows mounted in roofs with a certain interval of roof inclination angles and with window sashes of a certain weight.

DE 2 337 459 A discloses a lifting device in which a brake faces of a guidance, on which a slide shoe slides, are provided converging against each other along the path of the slide shoe. This provides a comparable braking effect as is disclosed in EP 1 873 323 A.

Thus, despite of these prior art solutions somewhat alleviating the mentioned problems, a need for further improving the ability of such a lifting device to adjust to different installation situations of an openable structure, such as a roof-mounted window, continues to exist. Further, lifting devices taking up less space, providing less wear and being cheaper to manufacture are desired.

SUMMARY OF THE INVENTION

With this background it is an object of the first aspect of the present invention to improve a lifting device of the kind mentioned in the introduction with respect to flexibility regarding different installation conditions as well as wear resistance and manufacturability.

This object is met by providing a lifting device adapted to be mounted in an openable structure for assisting in opening a first member of the structure relative to a second member of the structure, comprising a biased slide shoe adapted to be slidable with respect to the second or first member of said structure, a lifting arm having two ends, one end adapted to be pivotally connected with the first or second member of the structure and the other end associated with the slide shoe, and a braking device comprising at least one brake shoe slidable on a respective brake face of the lifting device, the braking device modulating a force resulting from the bias on the biased slide shoe in variation of a magnitude of the force. The lifting device is provided with an adjusting device adapted to adjust modulation of the force when the lifting device is in a mounted position on the openable structure, the adjusting device comprising a manipulation member, which when manipulated by a user, activates the adjusting device to adjust a brake force of the brake shoe exerted on the brake face in a given position of the brake shoe.

Hereby, it is possible for a user, an operator or a window installer to adjust a modulated braking device of a given lifting device of for example a certain window to a certain inclination of a roof, in which the window is or is to be mounted, or to a certain weight of the window sash including any optional accessories.

Thus, it is for example possible to adjust the braking effect such as to be larger at near-closed positions of the window, but smaller at larger opening angles, maintaining the advantages of the prior art braking devices. If the window is installed in a roof of greater inclination, and/or if the weight of the window sash including accessories is small, the gravitational forces in near-closed positions are smaller, and the braking device can be accordingly adjusted to provide a smaller braking effect. If the window is installed in a roof of smaller inclination, and/or if the weight of the window sash including accessories is greater, the gravitational forces in near-closed positions are greater, and the braking device can be adjusted to provide a greater braking effect. In both cases, the braking device can be adapted to progressively get smaller when the window is moved to larger opening angles in which the slide shoe provides a greater braking effect and the need for additional braking is smaller.

With the lifting device according to the first aspect of the invention it is thus possible for a larger number of inclination angles of the surface in which the openable structure is to be mounted within all opening angles to provide a suitable, near-constant value of the force to be exerted by user on the window in order to change its position. And the same is the case regarding the weight of the window sash including any accessories.

Furthermore, should the braking characteristics of the braking device change in the lifetime of the window, e.g. due to wear of a braking shoe, it is possible for a user to readily manipulate the manipulation member of the adjusting device to adjust the braking effect accordingly without having to separate any parts from or exchange any parts of the window. The same is the case should it be desired to remount the window in a roof of another inclination or to install or uninstall any accessories, such as a screening device.

In a preferred embodiment said adjusting device is adapted to modulate said force progressively, i.e. continuously decreasingly or increasingly, in relation to said magnitude of said force, preferably said force is modulated such as to vary substantially proportionally with said magnitude of said force. Hereby, the modulation can be adapted to correspond to the variation of the moment exerted by the window sash when the window is opened or closed. In some cases, instead of a proportional variation, an exponential or other non-linear variation might be preferable. In other embodiments the modulation is not necessarily progressive; it might vary between increasing and decreasing increments, for example in order to provide a stepwise positioning of the window sash in certain opening positions (corresponding to the embodiments shown in FIGS. 6 and 7 of EP 1 873 323 A).

In another preferred embodiment said adjusting device comprises an abutment member with a slide face abutting a corresponding slide face of said brake shoe, at least one of said slide faces being inclined with respect to a sliding direction of said slide shoe. In a development of this embodiment said spring arrangement comprises a helical main spring with a spring rod extending there-through and providing said brake face, one of said abutment member and said brake shoe being axially movable with a first end of said helical main spring, and the other being adapted to be axially fixed in relation to that of said first and second members with respect to which said biased slide shoe is adapted to be slidable such that movement of said slide shoe in relation to said first or second member of said structure causes said slide face of said abutment member to slide on said slide face of said brake shoe, thus providing said modulation, said adjusting device being adapted to adjust an inclination of said inclined slide face. This provides a small, wear-resistant and efficient braking device of which the modulation can be easily adjusted. Further, this embodiment provides more flexibility in positioning of the braking device, making it possible to position the braking device anywhere in the length direction of the spring rod. In a further development said brake shoe comprises at least two brake shoe segments abutting different brake face segments of said spring rod, each said brake shoe segment communicating with a different respective segment of said inclined slide surface, said adjusting device being adapted to adjust said brake shoe segments towards each other such as to adjust an inclination of said inclined surface segments. The provision of at least two brake shoe segments working in different directions enhances the stability and reliability of the lifting device, and reduces wear. Furthermore, the adjusting device can be readily manufactured and installed.

In a further embodiment said adjusting device comprises an adjustment member, said adjustment member being deformable or angularly displaceable on activation of said adjusting device. In a development of this embodiment said adjustment member is in the form of a guidance portion forming said brake face. This is especially advantageous in cases in which the braking device is of the type comprising a linkage mechanism having two brake shoes connected with each other by a link extending at an angle with respect to said guidance portion in contact with a respective brake shoe. In the case of the previously mentioned embodiment comprising such an abutment member, said adjustment member and the abutment member are preferably integral, i.e. one and the same member.

In another embodiment said braking device comprises a linkage mechanism having two said brake shoes connected with each other by a link extending at an angle with respect to a guidance portion forming said brake face in contact with a respective brake shoe, said adjusting device being adapted to adjust a length of said link. This provides an alternatively adjustable braking device of the type comprising a linkage mechanism.

In another embodiment said braking device comprises two laterally projecting said brake shoes abutting a guidance portion forming said brake face, said adjusting device being adapted to be inserted between said brake shoes to push them away from each other in order to adjust said brake force of said brake shoe exerted on said brake face. In a development of this embodiment said braking device comprises an abutment member with respective slide faces abutting corresponding respective slide faces of said laterally projecting brake shoes, at least one of said slide faces being inclined with respect to a sliding direction of said slide shoe, said abutment member being connected to said spring arrangement such that movement of said slide shoe in relation to said first or second member of said structure causes said slide face of said abutment member to slide on said slide faces of said brake shoes, thus modulating a force of said brake shoe exerted on said guidance portion. This provides a braking device, which can be included as part of the slide shoe.

In another embodiment said adjusting device comprises a threaded member, such as a screw, which when the manipulation member in the form of a head or like of said threaded member is activated adjusts said modulation. Hereby, a user can easily activate the adjusting device directly with by hand or with a screwdriver or like tool. Instead of a threaded member a tapered or wedge-shaped member, for example, can be applied, wherein the member may comprise barbs or the like in order to provide a stepwise adjustment and/or a snap locking engagement. Similarly, with a threaded member, a stepwise or continuous adjustment is possible.

The object of the second aspect of the present invention is to improve a lifting device of the kind mentioned in the introduction with respect to wear resistance, size, reliability and manufacturability.

This object is met by providing a lifting device adapted to be mounted in an openable structure for assisting in opening a first member of the structure relative to a second member of the structure, comprising a biased slide shoe adapted to be slidable with respect to the second or first member of the structure, the slide shoe being biased by means of a spring arrangement, a lifting arm having two ends, one end adapted to be pivotally connected with the first or second member of the structure and the other end associated with the slide shoe, and a braking device comprising at least one brake shoe slidable on a respective brake face of the lifting device, the braking device modulating a force resulting from the bias on the biased slide shoe in variation of a magnitude of the force. The lifting device is further provided with an abutment member with a slide face abutting a corresponding slide face of the brake shoe, at least one of the slide faces being inclined with respect to a sliding direction of the slide shoe, one of the abutment member and the brake shoe being connected to the spring arrangement, and the other being adapted to be axially fixed in relation to the slide shoe or in relation to that of the first and second members with respect to which the biased slide shoe is adapted to be slidable such that movement of the slide shoe in relation to the first or second member of the structure causes the slide face of the abutment member to slide on the slide face of the brake shoe providing a wedging effect between the brake shoe and abutment member, which modulates a brake force of the brake shoe exerted on the brake face dependent on a position of the slide shoe with respect to the second or first member of the structure.

The provision of such an abutment member provides more flexibility in positioning of the braking device. Also, it is possible to use a spring rod as the brake face, making it possible to position the braking device both anywhere in the length direction of the spring rod or in the slide shoe while maintaining the modulation of the braking force.

The lifting device is subjected to less wear and will continue to function properly even when moderately worn because the inclined face will better adjust to wear of the brake shoe or brake face. Further, it is more stable and reliable.

In a preferred embodiment said adjusting device is adapted to modulate said force progressively, i.e. continuously decreasingly or increasingly, in relation to said magnitude of said force, preferably said force is modulated such as to vary substantially proportionally with said magnitude of said force. Hereby, the modulation can be adapted to correspond to the variation of the moment exerted by the window sash when the window is opened or closed. In some cases, instead of a proportional variation, an exponential or other non-linear variation might be preferable. In other embodiments the modulation is not necessarily progressive; it might vary between increasing and decreasing increments, for example in order to provide a stepwise positioning of the window sash in certain opening positions (corresponding to the embodiments shown in FIGS. 6 and 7 of EP 1 873 323 A).

In another preferred embodiment said spring arrangement comprises a helical main spring with a spring rod extending there-through, said brake face being in the form of a surface of said spring rod. Said abutment member and said brake shoe are preferably positioned surrounding said spring rod, one of said abutment member and said brake shoe being axially movable with a first end of said main helical spring, and the other being adapted to be axially fixed in relation to that of said first and second members with respect to which said biased slide shoe is adapted to be slidable. This improves stability and reliability as well as reduces wear. In a further development of this embodiment said spring arrangement comprises a main helical spring and an auxiliary helical spring positioned in continuation of said main helical spring, said braking device being positioned between said main and auxiliary helical springs. Further, a more light-weight modulating braking device can be located in a position of the lifting device, in which typical windows have room to spare. This provides a lifting device, which is smaller. In another or further development said brake shoe comprises at least two brake shoe segments abutting different brake face segments of said spring rod, each said brake shoe segment communicating with a different respective segment of said inclined slide surface. The provision of at least two brake shoe segments working in different directions enhances the stability and reliability of the lifting device, and reduces wear. Furthermore, the adjusting device can be readily manufactured and installed.

In another preferred embodiment the inclination of said inclined slide surface is adjustable. This provides a lifting device with the advantages of adjusting the modulation of the braking device similar to the advantages described above with respect to the first aspect of the present invention. In a further development combining this and the previous embodiment said brake shoe segments each provide a segment of said inclined surface, said brake shoe segments being adjustable towards each other such as to enable adjustment of an inclination of said inclined surface segments, preferably at least one adjustment member, such as a threaded member, connects said brake shoe segments.

In another embodiment a first of said slide faces is linearly inclined, and the other curves convexly towards said first slide face, preferably said first slide face is cone-shaped, and said other slide face is dome-shaped. This ensures contact between the slide faces also in the event of wear in the braking device.

In another embodiment said braking device further comprises a second, similarly shaped, but reversed brake shoe positioned in axial continuation of the first brake shoe, said second brake shoe abutting a second, similarly shaped abutment member.

In a third aspect. the invention provides a window comprising a frame and a sash, characterized in that at least one lifting device is mounted on the frame and the sash.

In the following, the invention will be described in further detail with reference to the accompanying drawings, in which

DETAILED DESCRIPTION OF THE PREFERRED EMBODIMENTS.

Figure 1:
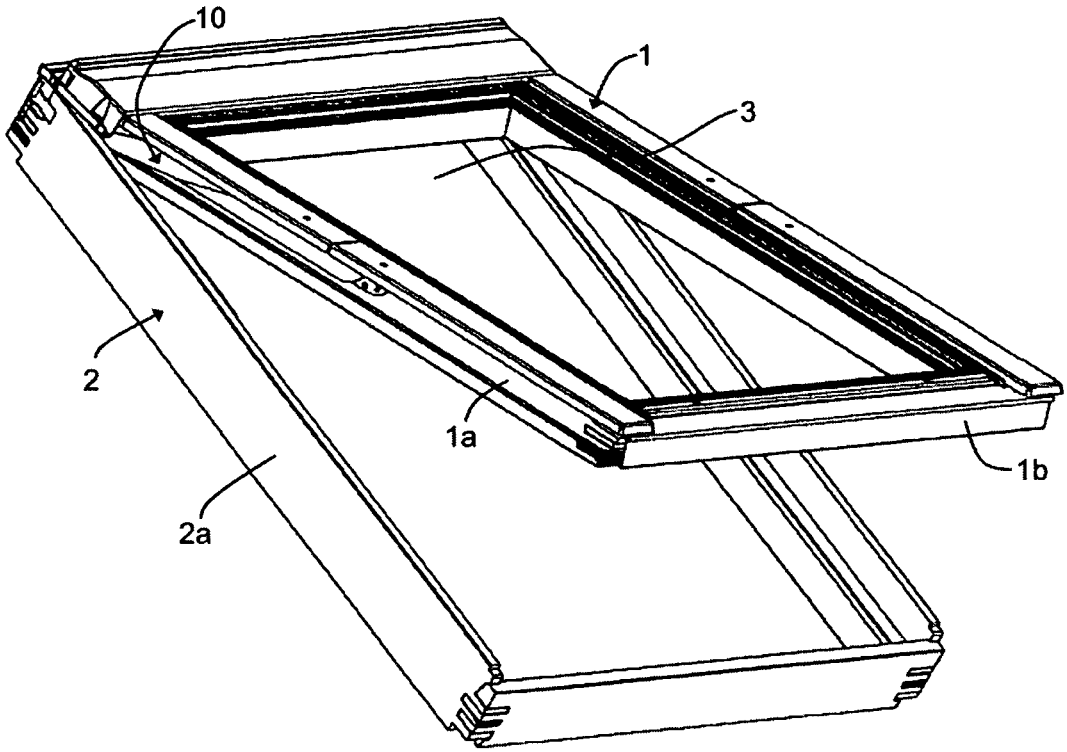
FIG. 1 shows a perspective view of an embodiment of a top-hung window according to the third aspect of the present invention provided with a lifting device according to the first and/or second aspect of the invention, the window being in an open position.

FIG. 1 shows an openable structure in the form of a top-hung window comprising a first member in the form of a sash 1 and a second member in the form of a frame 2, the sash 1 being openable relative to the frame 2. The window is an embodiment of the window according to the third aspect of the present invention. The window is to be built into a surface (not shown), such as a roof, which may be inclined with respect to the horizontal as is suggested by the shown overall inclination of the window in FIG. 1. At the top of the frame 2 a hinge connection connects to the sash 1 carrying a glazing 3. The hinge connection will be described in further detail below. In a manner known per se, the frame 2 and sash 1 are each formed by four members of which the frame side member 2*a*, the sash side member 1*a*, and sash bottom member 1*b* are indicated. The sash 1 is openable with respect to the frame 2 as the sash 1 is moved from a closed position, in which e.g. the sash side member 1*a* is substantially parallel with the frame side member 2*a*, to an open position, in which the sash side member 1*a* forms an angle with the frame side member 2*a*. During this movement the sash 1 rotates about at hinge axis situated at the hinge connection at the top of the frame 2 and the sash 1. For assisting the movement of the sash 1 from the closed position to an open position, a lifting device generally designated 10 is mounted between the sash 1 and the frame 2 in a manner that will be described in further detail below. Other embodiments of the window are conceivable; e.g. the frame could be connected, at the top, with an intermediate frame constituting a support to a glass-carrying pivotal sash, which is able to rotate or pivot about a central hinge axis of the sash. The pivotal sash would, in this case, be connected with the intermediate frame by means of an upper closing means, the hinges at the top thus being in use at normal operation of the sash during opening and closing, while the pivoting function is mainly used for cleaning the outside of the glass.

Figure 2:
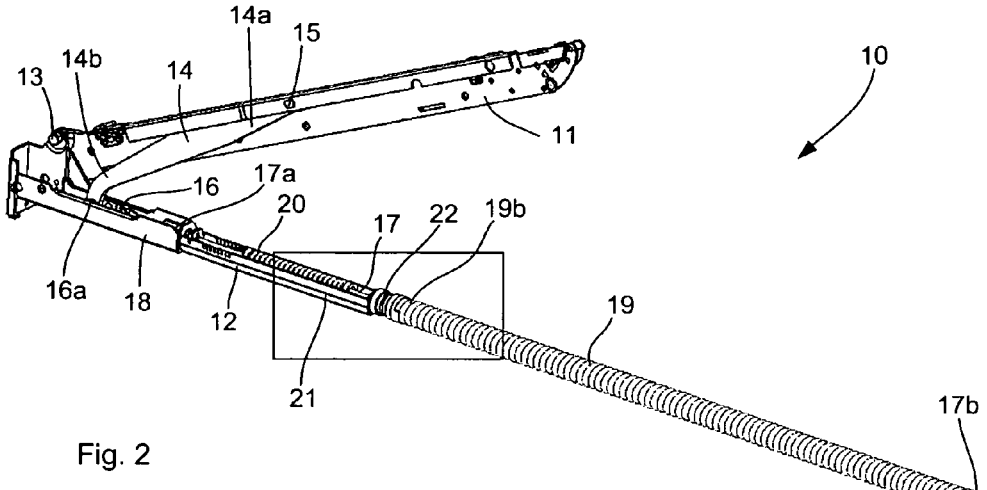
FIG. 2 shows a perspective view of a first embodiment of a lifting device, this embodiment being according to the second aspect of the present invention.

FIG. 2 shows a detailed view of the lifting device 10 of the window shown in FIG. 1, the lifting device being according to a first embodiment of the second aspect of the present invention. The lifting device 10 comprises a first plate member 11 and a second plate member 12. The first and second plate members 11, 12 are connected with each other by means of a hinge 13. In the embodiment of the window shown in FIG. 1, the first plate member 11 is connected with the sash side member 1*a*, the second plate member 12 being connected with the frame side member 2*a*. A similar, mirror-inverted lifting device is correspondingly positioned at the opposite side members of the sash and frame. When the window is mounted in the surface (not shown), the second plate member 12 is connected with the stationary part of the structure in question, in casu the frame 2. In case the window is provided with an intermediate frame as described in the above, the connection between the intermediate frame and the glass-carrying sash could, e.g., be situated at the end of the first plate member 11 opposite relative to the hinge 13.

A lifting arm 14 of the lifting device 10 is at one end 14*a* pivotally connected by means of a hinge 15 with the first plate member 11 and at the other end 14*b* associated, i.e. connected by means of another hinge 16*a*, with a slide shoe 16. The slide shoe 16 is again connected to one end 17*a* of a spring rod 17, which will be described in further detail below. As will be described in more detail in connection with the below description of the operation of the lifting device, the slide shoe 16 is displaceable or slidable in a longitudinal direction of the frame side member 2*a* on a guidance portion 18 of the second plate member 12. However, in the present specification the term "slide shoe" should be interpreted to cover any element which is capable of performing such a displacement by means of any combination of movements including sliding, rolling etc.

As can be seen in FIG. 2, the guidance portion 18 is substantially U-shaped with a plate-shaped bottom part (not visible), which when mounted on the window extends along and coplanarly abuts a surface of the frame member 2*a*, and two side parts or legs extending normal to the bottom member. When the slide shoe 16 slides in the guidance portion 18, the weight of the sash 1 forces the slide shoe 16 against the bottom part providing a frictional braking contribution to the operation of the window as was described above in the introductory part of the description. Due to the angular movement of the lifting arm 14 this braking effect is near zero when the window is in a near-closed position and increases as the window is opened.

The slide shoe 16 is biased, the term "biased" in the present specification being given the meaning "influenced by any means providing a load on the slide shoe". This bias may be provided in any suitable manner. In the present embodiment, the bias is provided by a spring arrangement. The spring arrangement comprises a helical main spring 19 and an adjustable helical auxiliary spring 20 in a way generally similar to what is described in previously mentioned European patent No. 0 733 146 B1. Both springs 19, 20 are compression springs. The auxiliary spring 20 is embedded in a U-shaped spring housing portion 21 of the second plate member 12, the spring housing 21 provided in axial continuation of the guidance portion 18. The spring rod 17 extends from its first end 17*a*, which is fixed to the slide shoe 16, through central apertures of first the auxiliary spring 20 and then the main spring 19 to be fixed to a first, lower end 19*a* of the main spring 19. A description of further details and the functioning of a similar spring arrangement known per se can be found in previously mentioned European patent No. 0 733 146 B1.

A braking device 22 of the lifting device 10 is provided between the spring housing 21 and the main spring 19.

Figure 2A:
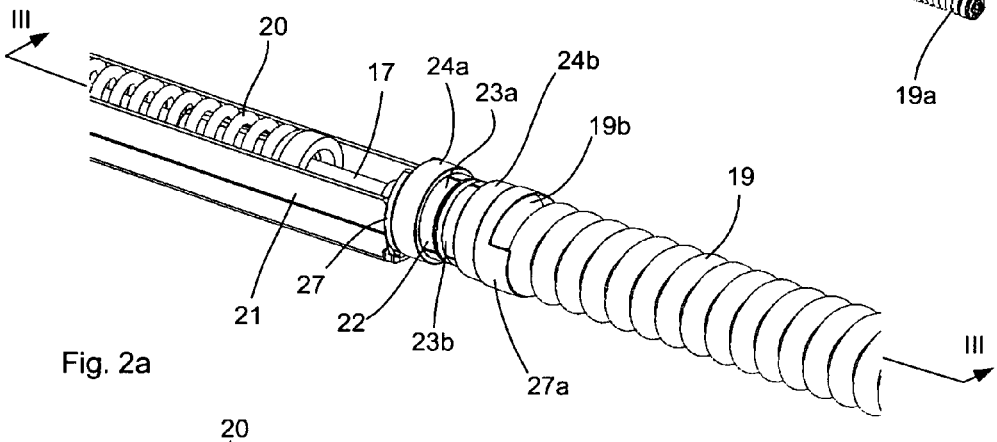
FIG. 2*a* shows a perspective view of a detail of the lifting device of FIG. 2.
Figure 2B:
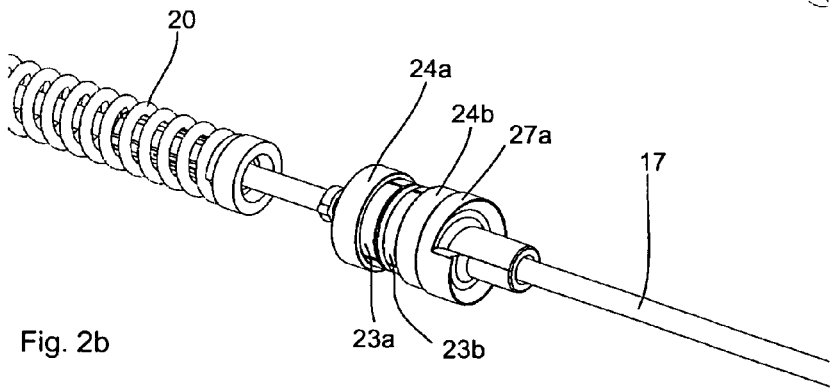
FIG. 2*b* shows a view similar to FIG. 2*a* with some parts of the lifting device hidden.
Figure 3:
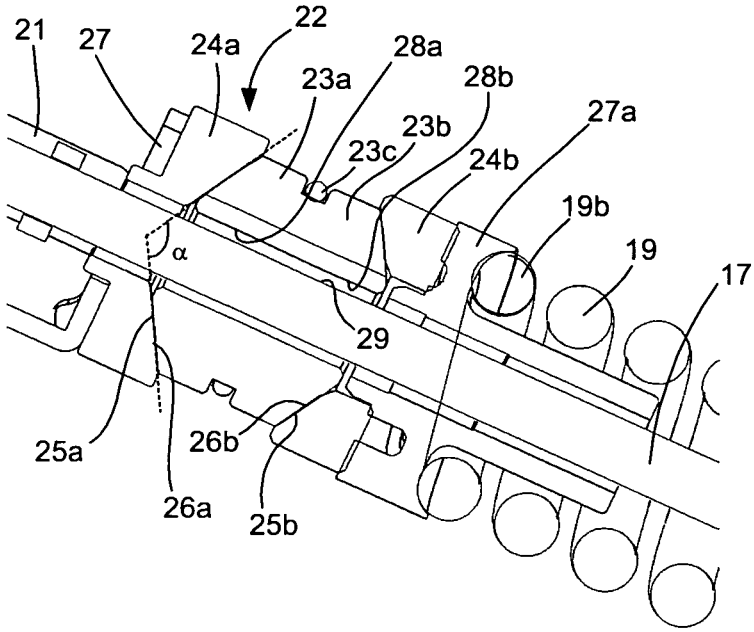
FIG. 3 shows a detail of a cross section taken along the line III-III in FIG. 2*a;*

FIGS. 2*a* and 2*b* show an enlarged view of a detail of FIG. 2, the detail showing the position of the braking device 22. In FIG. 2*b* the second plate member 12 and the main spring 19 have been hidden for clarity reasons. In turn, FIG. 3 shows a detail of a cross section taken along the line III-III in FIG. 2*a* through the braking device 22. Furthermore, FIGS. 3*a* and 3*b* show the braking device 22 separated from the remaining parts of the lifting device 10, the latter figure showing an exploded view.

Referring to FIGS. 2*a* to 3*b* the braking device 22 comprises two brake shoes 23*a*, 23*b*, which are in the present case moulded integrally from a suitable friction-inducing material, preferably a plastics material such as POM9021C. The braking device 22 further comprises two abutment members 24*a*, 24*b*, which are in the present case manufactured from steel. Each brake shoe 23*a*, 23*b* comprises a respective slide face 25*a*, 25*b*, each abutting a corresponding respective slide face 26*a*, 26*b* of each abutment member 24*a*, 24*b*. Each of the slide faces 25*a*, 25*b*; 26*a*, 26*b* is inclined with respect to a sliding direction of the slide shoe 16, i.e. with respect to a longitudinal direction of the second plate member 12 and the frame side member 1*a*.

Figure 3A:
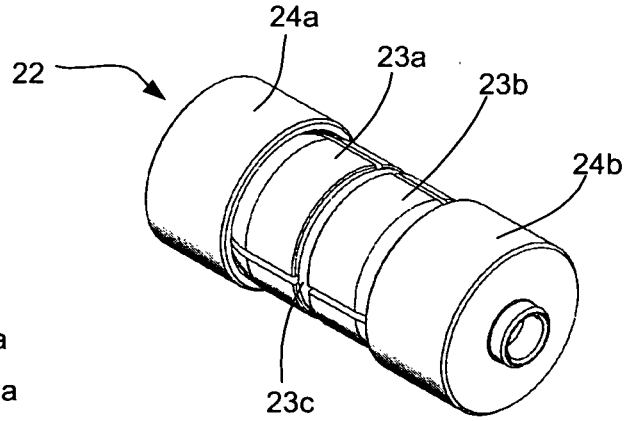
FIG. 3*a* shows a perspective view of a braking device of the lifting device shown in FIG. 2 in a braking position.
Figure 3B:
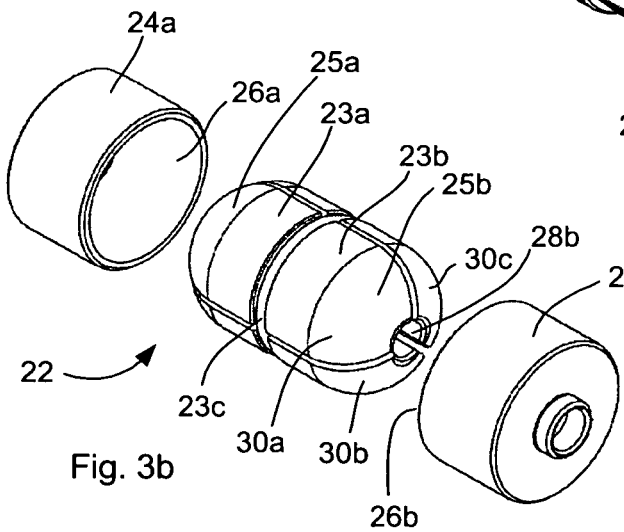
FIG. 3*b* shows an exploded view corresponding to the view of FIG. 3*a;*

As can be seen from FIGS. 2 to 3*a*, in an installed position the abutment members 24*a*, 24*b* and the brake shoes 23*a*, 23*b* are positioned abutting each other in axial continuation of each other, each of them surrounding the spring rod 17. A first 24*a* of the abutment members is axially fixed in relation to the frame member 2*a*; more specifically the first abutment member 24*a* is axially restricted from movement in one axial direction by abutting an abutment part 27 of the spring housing 21, which is axially fixed in relation to the frame member 2*a*. The abutment part 27 is formed as part of a bottom part of the spring housing 21 having been bent upwards. The first abutment member 24*a* is restricted from movement in the opposite axial direction by abutting a first 23*a* of the brake shoes, the latter being forced against the first abutment member 24*a* because of the compressing spring force of the main spring 19 acting in this direction. In turn, the first brake shoe 23*a* is connected to the spring arrangement, more specifically it is axially movable with the first end 19*a* of the main spring 19 via a second 23*b* of said brake shoes and a second 24*b* of the abutment members. The second abutment member is connected to the main spring 19 via a connecting member 27*a*.

The slide faces 25*a*, 25*b* are each linearly inclined inwards forming respective concave cone-shaped slide faces. Correspondingly, the slide faces 26*a*, 26*b* curve convexly towards the slide faces 25*a*, 25*b* forming respective dome-shaped or hemispherical slide faces, cf. FIG. 3*b*. However, since the brake shoes 23*a*, 23*b* are made from elastic or flexible material, in use the slide faces 26*a*, 26*b* are forced towards taking on a linear shape against the slide faces 25*a*, 25*b*. The curved form in the relaxed state of the slide faces 26*a*, 26*b* ensures contact between the slide faces also in the event of wear in the braking device or in the case of smaller loads on the braking device 22.

Each of the brake shoes 23*a*, 23*b* further has respective inwardly facing faces 28*a*, 28*b*, which are parallel to and slidable on a brake face 29 provided as a surface of the spring rod 17. As is seen best in FIG. 3*b* the integrally formed brake shoes 23*a*, 23*b* are divided into three common brake shoe segments or portions 30*a*, 30*b*, 30*c*. The part of the slide face 25*b* provided by each portion 30*a*, 30*b*, 30*c* slides on a corresponding different segment of the slide face 26*b*, and the part of the inwardly facing face 28*b* provided by each portion 30*a*, 30*b*, 30*c* slides on or brakes against a corresponding different segment of the brake face 29 of the spring rod 17. The brake shoe 23*a* has similar, oppositely facing segments or portions working in a similar way against the slide face 26*a*. The three portions 30*a*, 30*b*, 30*c* are of the same shape and size and distributed evenly about the spring rod 17. The portions 30*a*, 30*b*, 30*c* are separated from each other by a small spacing, allowing the internal diameter of the brake shoe 23*b* to vary relative to the force exerted by the main spring 19 on the braking device 22, thus varying the force exerted by brake shoe 23*b* on the brake face 29 and, thereby, the braking effect of the braking device 22 on the lifting device 10. The distinct portions 30*a*, 30*b*, 30*c* are prevented against radially being completely separated from each other by means of a circumferentially extending, elastic O-ring 23*c*, e.g. made from rubber, which is loosely provided encircling the portions 30*a*, 30*b*, 30*c*. This is primarily of importance during assembly of the braking device 22.

Operation of the window of FIG. 1 is described in the following with reference to FIGS. 1 to 3*b*. From a closed position, the user operates an operating device (not shown) of the window. The operating device may be a handle connected with the sash bottom member 1*b*, and may include auxiliary opening means such as one or more pressure medium cylinders, chain operators or the like. In combination with the force, and hence moment, exerted by the user pushing the operating device outwards, the moment resulting from the weight of the sash 1 is overcome. During this movement, the slide shoe 16 at the connection between the spring rod 17 and the lifting arm 14 is displaced along the guidance portion 18 of the second plate member 12. All in all, this operation entails that the sash 1 is moved from a closed position to an open position as represented by FIG. 1.

During opening of the window, the sash member 1*a* is moved towards a larger angle in relation to the frame member 2*a* (FIG. 1). The first plate member 11 via hinge 15 pulls the first end 14*a* of the lifting arm 14 away from the second plate member 12, the lifting arm 14 pivoting about hinges 15, 16*a* (FIG. 2). This causes the slide shoe 16, and hereby the spring rod 17, to move in the direction of the main spring 19, i.e. inclined downwards in FIG. 1. Thus, the end 17*b* of the spring rod 17 releases the load on the end 19*a* of the main spring 19, and the main spring 19 is extended. As can be best understood from FIGS. 3 to 3*b*, the smaller load exerted by the main spring end 19*b* on the second abutment member 24*b* via connection member 27*a* relieves the axial load on the braking device 22. Hereby, the distance between abutment part 27 and connection member 27*a* grows, and the radial inwardly directed force exerted by the three portions 30*a*, 30*b*, 30*c* of brake shoes 23*a*, 23*b* (FIG. 3*b*) is relieved, the slide faces 25*a*, 25*b* sliding on the slide faces 26*a*, 26*b*, thus also relieving the resultant brake force against the brake face 29 of the spring rod 17. As a result, the brake force of the brake shoes 23*a*, 23*b* exerted on the brake face 29 is progressively modulated, i.e. progressively decreased or relieved, dependent on the position of the slide shoe 16 with respect to the frame member 2*a*.

Closing the window from the open position entails the opposite movements of the sash 1 and relevant parts of the lifting device. Hereby, the brake shoes 23*a*, 23*b* are wedged into the conical abutment members 24*a*, 24*b* because of the inclined mutual slide faces 25*a*, 25*b*; 26*a*, 26*b*. Thus, during opening of the window, the movement of the slide shoe 16 in relation to the frame member 2*a* can be said to provide a wedging effect between the brake shoes 24*a*, 24*b* and the abutment members 24*a*, 24*b*, this wedging effect being reversed during opening of the window.

Thus, during the opening and the closing of the window, the braking device 22 incorporated into the lifting device 10 modulates the force resulting from the bias acting on the slide shoe 16 of the lifting device 10.

The degree of modulation depends on an angle α of the cone of each abutment member 24*a*, 24*b*, cf. FIG. 3. In the embodiment shown the angle α is about 120°. In other embodiments this angle α is adjustable such as to enable adjustment of the inclination of the inclined surface. This provides embodiments according to the second aspect of the invention, which are also in accordance with the first aspect of the invention. A more detailed description of a like embodiment is explained below with reference to FIGS. 6 to 7*b*.

In the embodiments of a lifting device shown in the following figures elements having the same or analogous function as in the embodiment described above carry the same reference numerals to which 100 has been added in each consecutive embodiment. Only differences with respect to the already described embodiment will be described.

Figure 4:
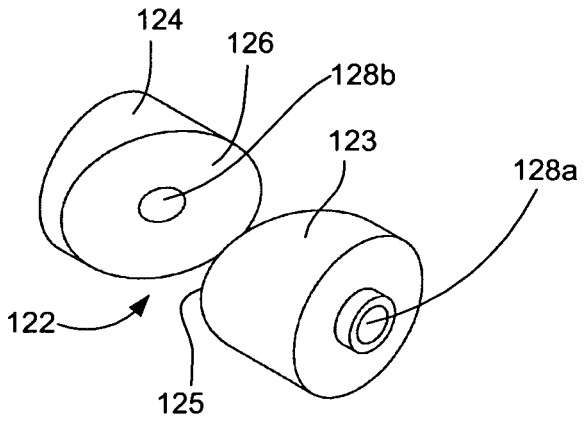
FIG. 4 shows an exploded perspective view of a braking device of a second embodiment of a lifting device, this lifting device being according to the second aspect of the present invention.

FIG. 4 shows a braking device 122 of a second embodiment of a lifting device, this lifting device being according to the second aspect of the present invention. This braking device 122 can be positioned similarly to the braking device 22 described in connection with the first embodiment described above; i.e. surrounding the spring rod 17 for example between the main spring 19 and the auxiliary spring 20.

In the following the braking device 122 is described in accordance to an embodiment in which it is inserted in a similar position as the braking device 22 of the previous embodiment. Thus, the braking device 122 comprises a circular-cylindrical abutment member 124, which is axially fixed in relation to the spring housing 21. The abutment member 124 is at one end cut off to form a linearly inclining slide face 126, which abuts a corresponding linearly inclining, but oppositely positioned slide face 125 of a brake shoe 123. The brake shoe 123 is of similar size and shape and is connected to the end 19*b* of the main spring 19. The brake shoe 123 and the abutment member are preferably manufactured from a plastic material such as POM9021C.

The brake shoe 123 further comprises an inwardly facing face 128*a*, which slides on and brakes against the spring rod 17 during opening and closing of the window, the brake shoe 123 as a whole being pushed radially outwards. If the abutment member 124 is not radially fixed in relation to the spring housing 21, an inwardly facing slide face 128*b* of the abutment member will slide on and exert a force of equal magnitude, but opposite direction, on the brake face 29 of the spring rod 17. It is noted that the abutment member 124 may or may not be radially fixed although it is preferred that it is not.

During operation the force of the brake shoe 123 exerted against the abutment member 124 varies because of the inclined mutually abutting slide faces 125, 126 in a way comparable to that described above in connection with the first embodiment. And again, the braking force exerted is varied depending on the position of the slide shoe 16.

Figure 5:
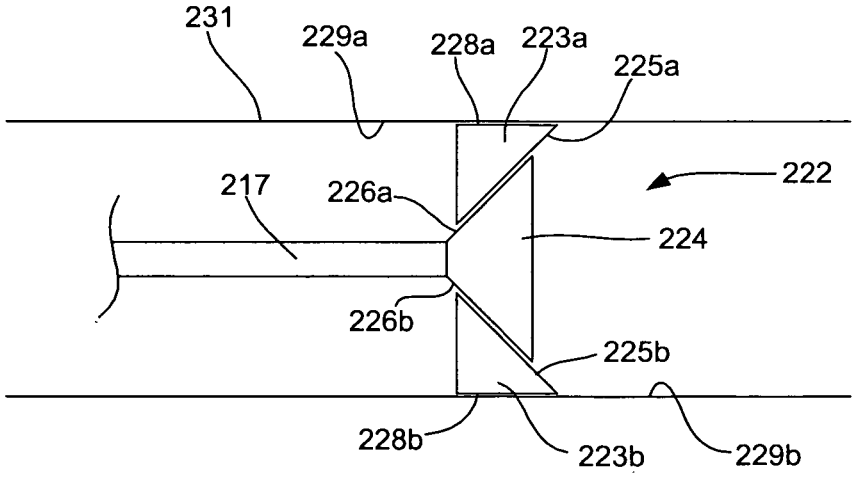
FIG. 5 shows a schematic exploded side view of a detail of a third embodiment of a lifting device, this lifting device being according to the second aspect of the present invention.

FIG. 5 shows a detail of a third embodiment of a lifting device, which is according to the second aspect of the invention. A braking device 222 of this lifting device comprises a centrally positioned abutment member 224 with lateral, linearly inclining slide faces 225*a*, 225*b*, which abut respective linearly inclining slide faces 225*a*, 225*b* of respective laterally projecting brake shoes 223*a*, 223*b*. The abutment member 224 is connected to, i.e. movable with, a spring arrangement, which may comprise a main spring 19 as described above, in which case the abutment member is preferably axially fixed in relation to an end 19*b* of the main spring 19. The brake shoes 223*a*, 223*b* are of equal size and shape and may be connected to, i.e. axially fixed in relation to, the slide shoe 16 of the embodiments described above. The brake shoes 223*a*, 223*b* and the abutment member 224 are preferably manufactured from a plastic material such as POM9021C. Alternatively, the abutment member 224 is manufactured from steel or the like.

The brake shoes 223*a*, 223*b* further each comprises a respective outwardly facing face 228*a*, 228*b*, which slides on and brakes against respective brake faces 229*a*, 229*b* of a guidance portion of the lifting device. The guidance portion can form part of the second plate member 12 of the above embodiments.

During opening and closing of the window, the brake shoes 223*a*, 223*b* are pushed radially outwards against the brake faces 229*a*, 229*b*. Thus, during operation the force of the brake shoes 223*a*, 223*b* exerted against the abutment member 224 varies because of the inclined mutually abutting slide faces 225*a*, 225*b*; 226*a*, 226*b* in a way comparable to that described above in connection with the first and second embodiments. And again, the braking force exerted is varied depending on the position of the window.

Figure 6:
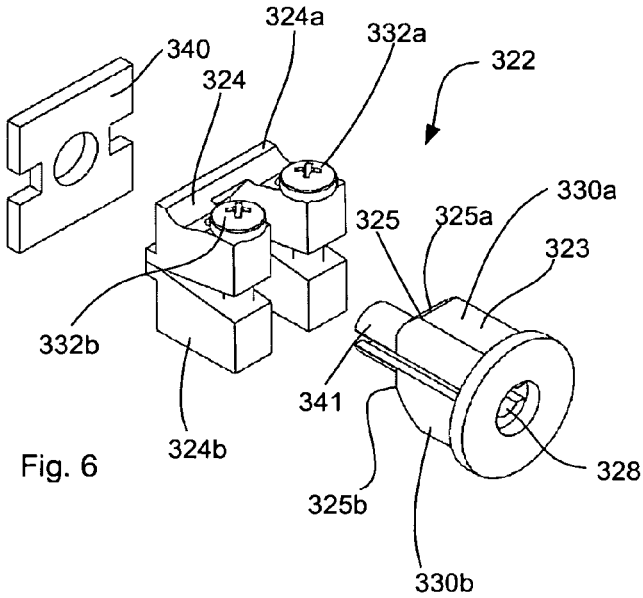
FIG. 6 shows a detailed perspective view of a braking device of a fourth embodiment of a lifting device, this embodiment being in accordance with both the first and second aspects of the present invention.
Figure 7A:
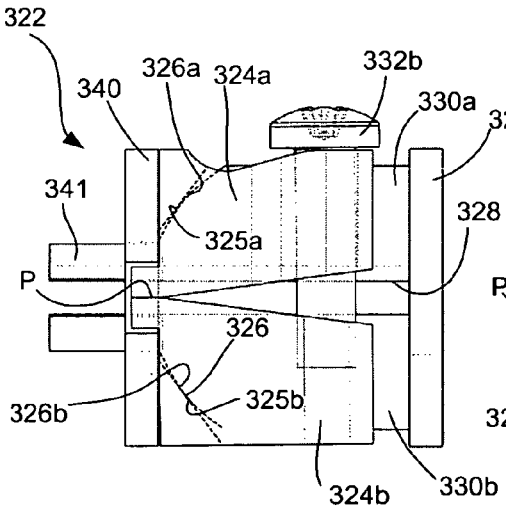
FIG. 7*a* shows a side view of the braking device of FIG. 6 adjusted to deliver a first braking effect.
Figure 7B:
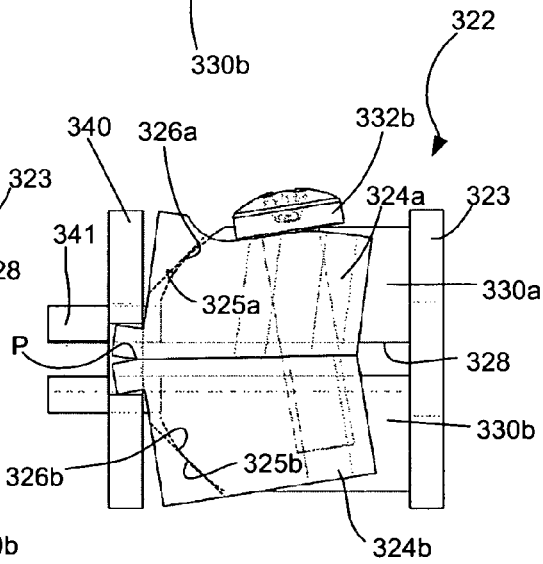
FIG. 7*b* shows a view corresponding to that of FIG. 7*a* adjusted to deliver a second braking effect.

FIGS. 6, 7*a* and 7*b* show a braking device 322 of a fourth embodiment of a lifting device, this lifting device being in accordance with both the first and second aspects of the present invention. Again, this braking device 322 can be positioned similarly to the braking device 22 described in connection with the first embodiment described above; i.e. surrounding the spring rod 17 for example between the main spring 19 and the auxiliary spring 20.

In the following the braking device 322 is described in accordance with an embodiment of a lifting device in which it is inserted in a similar position as the braking device 22 of the above first embodiment.

The braking device 322 comprises an abutment member 324, which is axially fixed in relation to the spring housing 21. The abutment member 324 comprises two separately provided parts 324*a*, 324*b*, which at respective first ends abut each other, extending away from each other as two legs towards respective second ends, cf. FIG. 7*a*. The parts 324*a*, 324*b* are connected at their second ends by means of an adjusting device comprising two threaded bolts 332*a*, 332*b* extending through and mating with two respective threaded holes extending through one leg of each part 324*a*, 324*b*. Activation of the threaded bolts 332*a*, 332*b* varies the distance between the respective seconds ends of the parts 324*a*, 324*b*, the parts 324*a*, 324*b* rotating about a point P at their first ends at which they abut each other in all positions of the bolts 332*a*, 332*b*. Each of the parts 324*a*, 324*b* can thus be said to form an adjustment member of the adjusting device, each said adjustment member being angularly displaceable about the point P on activation of the threaded bolts 332*a*, 332*b* of the adjusting device.

The parts 324*a*, 324*b* comprise a mutual slide face 326, each part comprising a respective linearly inclining slide face segment 326*a*, 326*b*, which abuts corresponding inclining, oppositely positioned slide face segments 325*a*, 325*b* of a slide face 325 of a brake shoe 323. The slide face 325 is curved in a way providing advantages similar to those described above in connection with the slide faces 25*a*, 25*b* of the first embodiment. As in the second embodiment above, the brake shoe 323 is connected to the end 19*b* of the main spring 19. Comparable to the brake shoe 23 of the first embodiment the brake shoe 323 of the present embodiment comprises two portions 330*a*, 330*b*, each providing one slide face segment 325*a*, 325*b*. The brake shoe 323 can be manufactured from a plastic material such as POM9021C, and the abutment member 324 can be manufactured from steel. The brake shoe portions 330*a*, 330*b* further define an inwardly facing face 328, which slides on and brakes against the spring rod 17 during opening and closing of the window in a way comparable to the previous embodiments.

Thus, during operation the force of the brake shoe 323 exerted against the abutment member 324 varies because of the inclined, mutually abutting slide faces 325, 326 in a way comparable to that described above in connection with the previous embodiments. And again, the braking force exerted is varied depending on the position of the slide shoe 16.

The threaded bolts 332*a*, 332*b* each comprise a manipulation member in the form of a head provided with a standard screw slot. Hereby, a user can manipulate, i.e. screw by means of a screwdriver, the threaded bolts 332*a*, 332*b*, providing a stepless variation of the distance between the second ends of the abutment member parts 326*a*, 326*b*. Activating the threaded bolts 332*a*, 332*b* thus adjusts a brake force of the brake shoe 323 exerted on the brake face 29 of the spring rod 17 in a given position of the brake shoe 323. Accordingly, the modulation of the force resulting from the spring bias on the biased slide shoe 16 is varied progressively in a stepless fashion.

The brake shoe 323 further comprises a connection projection 340, which in the assembled or braking state of the braking device 322 extends through a corresponding aperture (not visible) of the abutment member 324 into an assembly member 341. The assembly member 341 holds the first ends of the parts 324*a*, 324*b* against each other and, corresponding to the O-ring 23*c* in the first embodiment, ensures that the two parts 324*a*, 324*b* are not radially separated from each other at their first ends.

Figure 8:
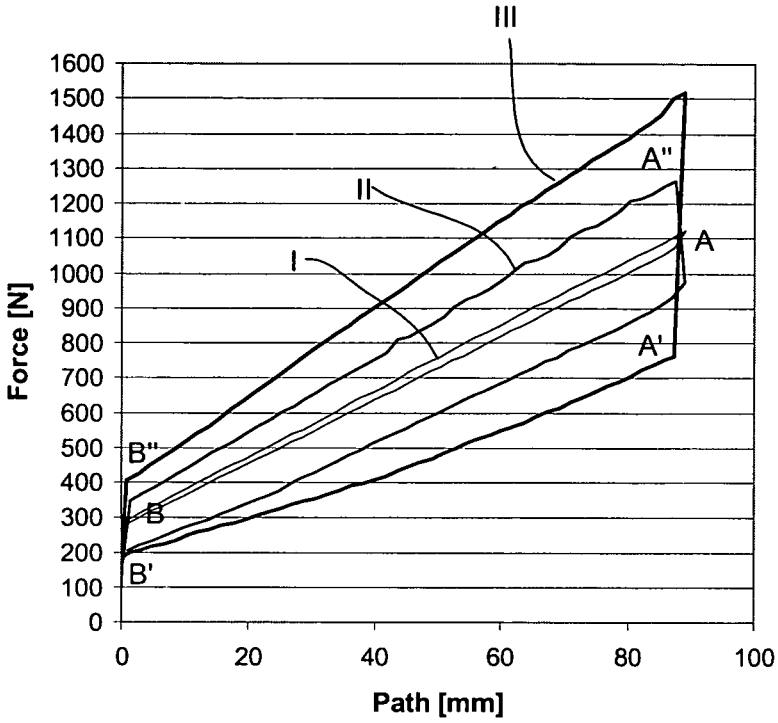
FIG. 8 shows a graph illustrating the relationship between force and distance travelled by parts of the lifting device as shown in FIG. 6 with varying values of the braking effect.
Figure 9:
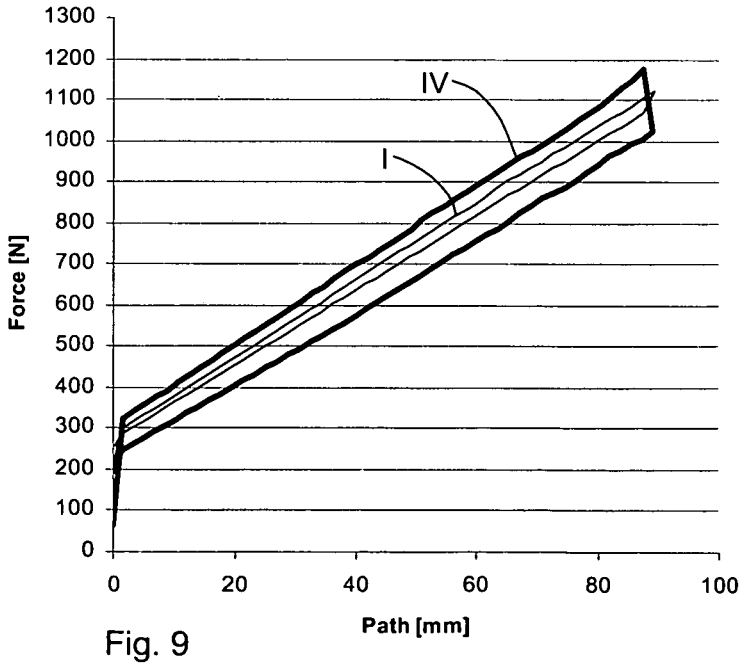
FIG. 9 shows a graph illustrating the relationship between force and distance travelled by parts of the lifting device as shown in FIG. 4.

In order to explain the fundamental principles underlying the lifting device according to the present invention, reference is made to FIGS. 8 and 9, which show graphs indicating the relationship between force and distance travelled (the path) in a conventional spring arrangement compared to different spring arrangements forming part of a lifting device 10 according to the first embodiment (FIGS. 1 to 3*b*) above and an corresponding embodiment in which the braking device 22 has been replaced with the braking device 122 of FIG. 4 (the second embodiment of a lifting device), respectively. Only the main spring 19, i.e. not the auxiliary spring 20, was active during the measurements.

In the conventional spring arrangement graph denoted I and shown in both FIGS. 8 and 9, the force is substantially proportional to the distance travelled and no or minimal hysteresis effect occurs. That is, the compressive force required to preload or bias the spring arrangement corresponds substantially to the tensional force resulting from the relief of the load or relaxation of the spring (indicated by points A and B, respectively).

The effect occurring in the lifting device 10 according to a modified version of the first embodiment described above, i.e. with a (modified) braking device 22 modulating the force, is indicated in FIG. 8 in the graphs denoted II and III, respectively. As with the conventional spring arrangement, the force during preloading and relief of the load, respectively, is proportional to the distance travelled by the main spring 19. However, during relief of the load, i.e. during opening of for instance a window as shown in FIG. 1, the force follows a curve starting at a point A' and ending at a point B' (the references A', A", B', B" referring to both graphs II and III). During biasing of the spring arrangement, i.e. during closing of the window, the resultant force describes a curve extending from point B" to A". Hence, the resultant curve describes different paths when relieving and biasing the spring arrangement, resulting in hysteresis. The reason for this is that the braking device 22 provides a braking force contribution to the spring force exerted by the main spring 19. The hysteresis has the effect that the window sash 1 is more stable when placed in an open position.

The force or moment, which is necessary for an operator to overcome on the window sash 1 in order to open or close the window, includes contributions from frictional forces between the slide shoe 16 and the guidance portion 18, gravitational forces working on the sash 1 as well as from the spring arrangement. As was initially explained, it is desired to provide a braking effect in the entire path of the window, which braking effect is great enough to stabilize the window in any opening angle.

The gravitational forces (or moment) depend on the opening angle of the window. The forces (or moment) exerted by the spring arrangement works in the opposite direction to counter the contribution from gravitation. As previously mentioned, the frictional forces between the slide shoe 16 and the guidance portion 18 increase as the window is opened, meaning that the braking effect is smallest when the window is near-closed. This means that to achieve the mentioned aim more braking effect is desired in the near-closed position of the window and less braking effect is desired in positions of larger opening angles. Note that these frictional forces depend on the angle in which the window as a whole has been mounted.

The progressive modulation of the force resulting from the function of the braking device 22 can be seen in the graphs II and III since the inclination of the graphs is lower between points A' and B' and greater between points B" and A". The progressive modulation of the force thus has the effect of providing the largest braking effect in the closed or near-closed position (A', A") and a progressively lower braking effect at larger opening angles. In other words the modulation of the force exerted by the spring arrangement increases when the frictional forces between slide shoe 16 and guidance portion 18 decreases, thus providing a more constant combined braking effect in the entire path of the window.

The graph II shows the operating curve of a spring arrangement provided with a braking device 22 in which the angle $\alpha$ has been modified to here be about 90°. The graph III shows the operating curve of a spring arrangement provided with a braking device 22 in which the angle $\alpha$ is about 60°. As can be seen both the braking effect and the hysteresis effect is much more pronounced in graph III.

Thus, the hysteresis effect may be optimized in accordance with the requirements of the chosen installation conditions. If the window is mounted in a roof of greater inclination, the frictional forces between the slide shoe 16 and the guidance portion 18 are small in a near-closed position of the window. In this case, it would be desirable to provide a braking device with a smaller angle $\alpha$. And, conversely, with a greater angle $\alpha$ in the case of a roof of smaller inclination.

The graph IV shown in FIG. 9 shows that a comparable hysteresis effect may be achieved with the braking device 122 of the second embodiment of a lifting device according to the invention. Note that a similar adjustment of the graph inclination as between the graphs II and III of FIG. 8 could be achieved if modifying the braking device 122 to be according to the braking device 422 of FIG. 10, which is explained below.

Figure 10:
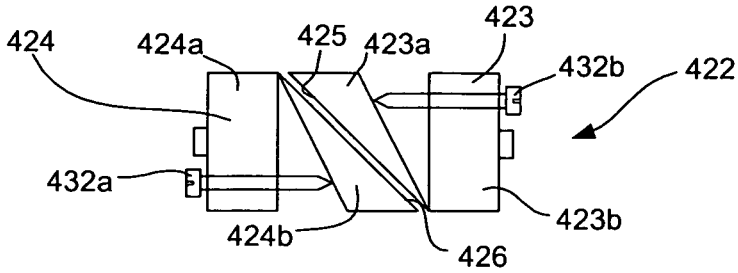
FIG. 10 shows a schematic side view of a braking device of a fifth embodiment of a lifting device, this lifting device being in accordance with the first and second aspects of the present invention.

FIG. 10 schematically shows a braking device 422 of a fifth embodiment of a lifting device, this lifting device being in accordance with the first and second aspects of the present invention. The braking device 422 is a development of the braking device 122 according to the second embodiment and shown in FIG. 4. Comparing to the braking device 122 both abutment member 424 and brake shoe 423 of this embodiment have been separated into two parts, denoted 424*a*, 424*b* and 423*a*, 423*b*, respectively; the embodiment in this respect being comparable to the fourth embodiment shown in FIGS. 6 to 7*b*. Consequently, an adjusting device comprising a screw 432*a*, 432*b* connects each pair of parts 424*a*, 424*b* and 423*a*, 423*b*, respectively, with each other. Comparably, activating the screws 432*a*, 432*b* adjusts a distance or angle between the respective parts 424*a*, 424*b*; 423*a*, 423*b*, varying the inclinations of slide faces 425, 426, and thus providing adjustment of the progressively modulated force. Each of the parts 423*a*, 424*b* can thus be said to form an adjustment member of the respective adjusting devices, each said adjustment member being angularly displaceable about a point on activation of the screws 432*a*, 432*b* of the adjusting devices.

Figure 11:
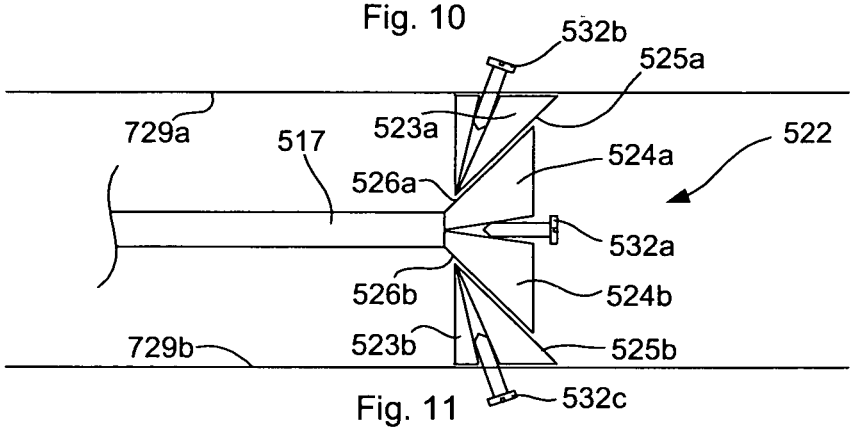
FIG. 11 shows a schematic side view of a detail of a sixth embodiment of a lifting device, this lifting device being in accordance with the first and second aspects of the present invention.

FIG. 11 schematically shows a braking device 522 of a fifth embodiment of a lifting device, this lifting device being in accordance with the first and second aspects of the present invention. The braking device 522 is a development of the braking device 222 according to the second embodiment and shown in FIG. 4. Comparing to the braking device 222 the abutment member 524 of this embodiment has been separated into two parts, denoted 524*a*, 524*b*; the embodiment in this respect being comparable to the fourth and fifth embodiments above. Again, an adjusting device comprising screws 532*a*, 532*b* and 532*c* connects the parts 524*a*, 524*b* with each other, and are similarly inserted in brakes shoes 523*a*, 523*b*, respectively. And, comparably, activating the screw 532*a* adjusts a distance or angle between the parts 524*a*, 524*b*, varying the inclinations of slide faces 525*a*, 525*b*; 526*a*, 526*b*, and thus providing adjustment of the progressively modulated force. Similarly and simultaneously the screws 532*b*, 532*c* are correspondingly adjusted to ensure parallelism between slide faces 525*a*, 526*a*; 525*b*, 526*b*, respectively. Here, each of the parts 524*a*, 524*b* can be said to form an adjustment member of the adjusting device, each said adjustment member being angularly displaceable about a point on activation of the screw 532*a* of the adjusting device. Thus, the adjusting device is adapted to be inserted between the brake shoes 523*a*, 523*b* to push them away from each other in order to adjust the brake force of the brake shoes 523*a*, 523*b* exerted on brake faces 529*a*, 529*b*.

Figure 12:
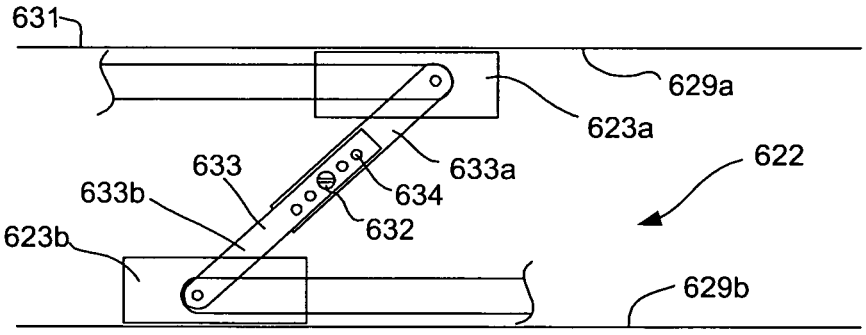
FIG. 12 shows a schematic side view of a detail of a seventh embodiment of a lifting device, this lifting device being in accordance with the first aspect of the present invention.
Figure 13:
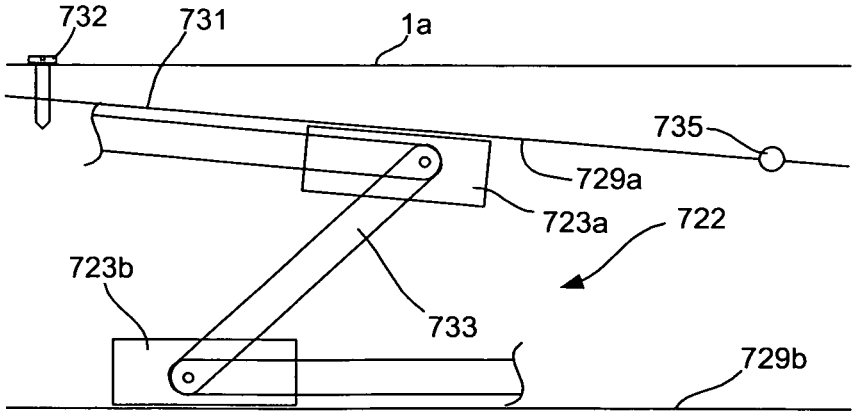
FIG. 13 shows a schematic side view of a detail of an eighth embodiment of a lifting device, this lifting device being in accordance with the first aspect of the present invention.

FIGS. 12 and 13 schematically show respective braking devices 622; 722 of a seventh and eighth embodiment of a lifting device, respectively, these lifting devices being in accordance with the first aspect of the present invention. More specifically, the figures show side views of a slide shoe 616; 716, respectively, incorporating a braking device 622; 722, respectively, of the lifting device. The lifting device generally corresponds to the lifting device shown in and described in connection with FIGS. 1 to 3 of Applicant's European patent application EP 1 873 323 A1, these specific references being incorporated herein.

In summary, the braking device 622; 722, respectively, comprises a linkage mechanism having two brake shoes 623*a*, 623*b*; 723*a*, 723*b*, respectively, connected with each other by means of a link 633; 733, respectively, extending at an angle with respect to each brake shoe 623*a*, 623*b*; 723*a*, 723*b*, respectively, such that the brake shoes 623*a*, 623*b*; 723*a*, 723*b*, respectively, and the link 633; 733, respectively, may assume a number of angular positions relative to each other. In a way similar to the embodiment of FIG. 5 the brake shoes 623*a*, 623*b*; 723*a*, 723*b* are slidable along opposed brake faces 629*a*, 629*b*; 729*a*, 729*b*, respectively, of an extended guidance portion 631; 731, respectively.

In order to enable adjustment of the progressively modulated force in the embodiment of FIG. 12 the link 633 has been separated into two parts 633*a*, 633*b*, which are axially or telescopically movable with respect to each other. The link parts 633*a*, 633*b* are each provided with a number of mutually corresponding holes 634 such that a length of the link 633 is adjustable by means of an adjusting device comprising a screw 632 extending through a hole 633 of each link part 633*a*, 633*b*. When adjusting this length, the screw 632 is taken out and reinserted in a different hole.

Comparably, in order to enable adjustment of the progressively modulated force in the embodiment of FIG. 13 an inclination of one brake face 729*a* of guidance portion 731 can be varied relative to the other brake face 729*b* about hinge 735. The inclination is adjusted by means of an adjusting device comprising a screw 732 secured to a side sash member 1*a* and extending through the brake face 729*a*. Here, a guidance portion providing the brake face 729*a* can thus be said to form an adjustment member of the adjusting device, said adjustment member being angularly displaceable about a point 735 on activation of the screw 732 of the adjusting devices.

The embodiments of FIGS. 12 and 13 may be modified in any of the ways shown in FIGS. 5 to 9 of EP 1 873 323 A1, for example the brake faces and brake shoes may be oppositely positioned as shown in FIG. 5 of this document.

The lifting device according to the first and/or second aspect of the present invention may be designed in other ways than the above-mentioned ones. For example, one or more brake shoes may be provided with a friction-adjusting layer to reduce wear. Also, instead of the slide shoe sliding on a side frame member, the lifting device can be reversed such that the slide shoe slides with respect to a side sash member, generally corresponding to the lifting device arrangement of the type shown in FIG. 1 of European patent EP 1 052 342 B1. Further, as with the lifting device shown in the latter document the spring arrangement may comprise a main spring in the form of a tension spring instead of a compression spring as is the case in the above-described embodiments.

In some cases, instead of a proportional variation (as with the above embodiments), an exponential or other non-linear variation of the force might be preferable. In other embodiments the modulation is not necessarily progressive; it might vary between increasing and decreasing increments, for example in order to provide a stepwise positioning of the window sash in certain opening positions (corresponding to the embodiments shown in FIGS. 6 and 7 of EP 1 873 323 A, the solutions of which can be directly implemented in the seventh and eighth embodiments above).

Comparably, the above slide faces 25*a* . . . 525*a* and 26*a* . . . 526*a* may have other forms than the above-described ones. In other embodiments they may for instance comprise cut-outs, barbs or the like in order to provide a stepwise modulation of the force resulting from the bias on the slide shoe. They may be curved, edged or comprise other variations of the slide face angle.

The invention claimed is:

1. A lifting device adapted to be mounted in an openable structure for assisting in opening a first member of the structure relative to a second member of the structure, comprising a biased slide shoe adapted to be slidable with respect to the second or first member of said structure so as to change a position of said slide shoe, a lifting arm having two ends, one end adapted to be pivotally connected with the first or second member of the structure and the other end associated with said slide shoe, and a braking device comprising at least one brake shoe slidable on a respective brake face of said lifting device, said braking device modulating a force resulting from the bias on said biased slide shoe in variation of said position of said slide shoe, characterized by further comprising an adjusting device adapted to adjust said modulation of said force when said lifting device is in a mounted position on said openable structure, said adjusting device comprising a manipulation member, which when manipulated by a user activates said adjusting device to adjust a brake force of said brake shoe exerted on said brake face independently from said position of said slide shoe.

2. A lifting device according to claim 1, wherein said braking device is adapted to modulate said force resulting from the bias progressively, continuously decreasingly or increasingly, in relation to said position of said slide shoe.

3. A lifting device according to claim 1, wherein said adjusting device comprises an abutment member with a slide face abutting a corresponding slide face of said brake shoe, at least one of said slide faces being inclined with respect to a sliding direction of said slide shoe.

4. A lifting device according to claim 3, wherein said spring arrangement comprises a helical main spring with a spring rod extending there-through and comprising said brake face, one of said abutment member and said brake shoe being axially movable with a first end of said helical main spring, and the other being adapted to be axially fixed in relation to that of said first and second members with respect to which said biased slide shoe is adapted to be slidable such that movement of said slide shoe in relation to said first or second member of said structure causes said slide face of said abutment member to slide on said slide face of said brake shoe, thus providing said modulation, said adjusting device being adapted to adjust an inclination of said inclined slide face.

5. A lifting device according to claim 4, wherein said brake shoe comprises at least two brake shoe segments abutting different brake face segments of said spring rod, each said brake shoe segment communicating with a different respective segment of an inclined slide surface, said adjusting device being adapted to adjust said brake shoe segments towards each other such as to adjust an inclination of inclined surface segments.

6. A lifting device according to claim 1, wherein said adjusting device comprises an adjustment member, said adjustment member being deformable or angularly displaceable on activation of said adjusting device.

7. A lifting device according to claim 6, wherein said adjustment member is a guidance portion forming said brake face.

8. A lifting device according to claim 7, wherein said braking device comprises a linkage mechanism having two brake shoes connected with each other by a link extending at an angle with respect to said guidance portion in contact with a respective brake shoe.

9. A lifting device according to claim 6, wherein said adjusting device comprises an abutment member with a slide face abutting a corresponding slide face of said brake shoe, at least one of said slide faces being inclined with respect to a sliding direction of said slide shoe, and wherein said adjustment member and said abutment member are integral.

10. A lifting device according to claim 1, wherein said braking device comprises a linkage mechanism having two said brake shoes connected with each other by a link extending at an angle with respect to a guidance portion forming said brake face in contact with a respective brake shoe, said adjusting device being adapted to adjust a length of said link.

11. A lifting device according to claim 1, wherein said braking device comprises two laterally projecting said brake shoes abutting a guidance portion forming said brake face, said adjusting device being adapted to be inserted between said brake shoes to push them away from each other in order to adjust said brake force of said brake shoe exerted on said brake face.

12. A lifting device according to claim 11, wherein said braking device comprises an abutment member with respective slide faces abutting corresponding respective slide faces of said laterally projecting brake shoes, at least one of said slide faces being inclined with respect to a sliding direction of said slide shoe, said abutment member being connected to said spring arrangement such that movement of said slide shoe in relation to said first or second member of said structure causes said slide face of said abutment member to slide on said slide faces of said brake shoes, thus modulating a force of said brake shoe exerted on said guidance portion.

13. A lifting device according to claim 1, wherein said adjusting device comprises a threaded member, which adjusts said modulation when the manipulation member embodied as a head or like of said threaded member is activated.

14. A lifting device according to claim 1, wherein said adjusting device is adapted to provide a stepless adjustment of said modulation.

15. A lifting device adapted to be mounted in an openable structure for assisting in opening a first member of the structure relative to a second member of the structure, comprising a biased slide shoe adapted to be slidable with respect to the second or first member of said structure so as to change a position of said slide shoe, said slide shoe being biased by means of a spring arrangement, a lifting arm having two ends, one end adapted to be pivotally connected with the first or second member of the structure and the other end associated with said slide shoe, and a braking device comprising at least one brake shoe slidable on a respective brake face of said lifting device, said braking device modulating a force resulting from the bias on said biased slide shoe in variation of said position of said slide shoe, characterized by further comprising an abutment member with a slide face abutting a corresponding slide face of said brake shoe, at least one of said slide faces being inclined with respect to a sliding direction of said slide shoe, one of said abutment member and said brake shoe being connected to said spring arrangement, and the other being axially fixed in relation to said slide shoe or in relation to that of said first and second members with respect to which said biased slide shoe is adapted to be slidable such that movement of said slide shoe in relation to said first or second member of said structure causes said slide face of said abutment member to slide on said slide face of said brake shoe providing a wedging effect between said brake shoe and said abutment member, which modulates a brake force of said brake shoe exerted on said brake face dependent on a position of said slide shoe with respect to said second or first member of said structure.

16. A lifting device according to claim 15, wherein said braking device is adapted to modulate said force resulting from the bias progressively, continuously decreasingly or increasingly, in relation to said magnitude of said force.

17. A lifting device according to claim 15, wherein said spring arrangement comprises a main helical spring with a spring rod extending there-through, said brake face being a surface of said spring rod.

18. A lifting device according to claim 17, wherein said abutment member and said brake shoe are positioned surrounding said spring rod, one of said abutment member and said brake shoe being axially movable with a first end of said main helical spring, and the other being adapted to be axially fixed in relation to that of said first and second members with respect to which said biased slide shoe is adapted to be slidable.

19. A lifting device according to claim 17, wherein said spring arrangement further comprises an auxiliary helical spring positioned in continuation of said main helical spring, said braking device being positioned between said main and auxiliary helical springs.

20. A lifting device according to claim 17, wherein said brake shoe comprises at least two brake shoe segments abutting different brake face segments of said spring rod, each said brake shoe segment communicating with a different respective segment of an inclined slide surface.

21. A lifting device according to claim 15, wherein inclination of an inclined slide surface is adjustable.

22. A lifting device according to claim 21, wherein the inclination of said inclined slide surface is adjustable, and wherein said brake shoe segments each provide a segment of said inclined slide surface, said brake shoe segments being adjustable towards each other such as to enable adjustment of an inclination of inclined surface segments.

23. A lifting device according to claim 15, wherein a first of said slide faces is linearly inclined, and the other curves convexly towards said first slide face.

24. A lifting device according to claim 15, wherein said braking device further comprises a second but reversed brake shoe having substantially the same shape as the first brake shoe and being positioned in axial continuation of the first brake shoe, said second brake shoe abutting a second abutment member having substantially the same shape as the first abutment member.

25. A lifting device according to claim 15, further comprising an adjusting device adapted to adjust when said lifting device is in a mounted position on said openable structure said modulation of said force, said adjusting device comprising a manipulation member, which when manipulated by a user activates said adjusting device to adjust said brake force of said brake shoe exerted on said brake face in a given position of said brake shoe.

26. A window comprising a frame and a sash, characterized in that at least one lifting device according to claim 15 is mounted on the frame and the sash.

27. A window according to claim 26, characterized in that the slide shoe is mounted on a side member of the frame and the lifting arm is pivotally connected with a side member of the sash.

28. A lifting device according to claim 2, wherein said force is modulated such as to vary substantially proportionally with said position of said slide shoe.

29. A lifting device according to claim 16, wherein said force is modulated so as to vary substantially proportionally with said position of said slide shoe.

30. A lifting device according to claim 22, wherein said first slide face is cone-shaped, and said other slide face is dome-shaped.

31. A lifting device according to claim 23, wherein at least one adjustment member connects said brake shoe segments.

* * * * *